US006744192B2

(12) United States Patent
Lehner

(10) Patent No.: US 6,744,192 B2
(45) Date of Patent: Jun. 1, 2004

(54) MULTIPOLE UNIT FOR A COLOR PICTURE TUBE WITH INTEGRATED SPRING ELEMENT

(75) Inventor: Heinz Lehner, Oberschneiding (DE)

(73) Assignee: Matsushita Display Devices (Europe) GmbH, Esslingen (DE)

( * ) Notice: Subject to any disclaimer, the term of this patent is extended or adjusted under 35 U.S.C. 154(b) by 248 days.

(21) Appl. No.: 09/870,423

(22) Filed: May 30, 2001

(65) Prior Publication Data

US 2002/0000769 A1 Jan. 3, 2002

(30) Foreign Application Priority Data

Jun. 7, 2000 (EP) ..... 000112269

(51) Int. Cl.[7] ..... H01J 29/70
(52) U.S. Cl. ..... 313/421; 313/412; 313/428
(58) Field of Search ..... 313/431, 433, 313/421, 428, 412; 335/211, 212

(56) References Cited

U.S. PATENT DOCUMENTS 4,050,042 A 9/1977 Anthony
4,065,737 A 12/1977 Anthony
4,728,854 A * 3/1988 Fendley ..... 313/407
4,898,746 A * 2/1990 Opresko ..... 427/10
5,955,830 A 9/1999 Uyama

FOREIGN PATENT DOCUMENTS

| | | |
|---|---|---|
| EP | 0 643 413 | 3/1995 |
| FR | 2224869 | 10/1974 |
| JP | 02 199749 | 8/1990 |
| JP | 10 188846 | 7/1998 |

* cited by examiner

*Primary Examiner*—Vip Patel
*Assistant Examiner*—Glenn Zimmerman
(74) *Attorney, Agent, or Firm*—Boyle Fredrickson Newholm Stein & Gratz S.C.

(57) ABSTRACT

A multipole unit normally consists of a support tube, a threaded ring, a plurality of magnetic rings, a plurality of spacer rings and a spring ring. According to the present invention, the structural design of a multipole unit is simplified in that the threaded ring is modified in such a way that the spring ring becomes superfluous. In order to achieve this the threaded ring or a stop arranged on the support tube is provided with spring elements which fulfil the function of the conventional spring ring.

4 Claims, 4 Drawing Sheets

MULTIPOLE UNIT FOR A COLOR PICTURE TUBE WITH INTEGRATED SPRING ELEMENT

BACKGROUND OF THE INVENTION

1. Field of the Invention

The present invention relates to a multipole unit for a color picture tube of the type including a support tube, a retaining ring, and at least one magnetic ring.

2. Description of the Related Art

Color picture tubes for color television sets and color monitors are provided with a multipole unit by means of which static convergence adjustment is carried out. Convergence adjustment guarantees that the three color separation images which are produced in a color picture tube appear on the front screen with raster superposition, i.e. that the three electron beams of the electron gun impinge on respective neighbouring, associated phosphor dots over the whole screen area. This will only be the case if the electron beams cross in a common shadow mask opening of the shadow mask provided on the inner side of the front screen in the picture tube. In the case of static convergence adjustment minor deviations of the electron beams are corrected with the aid of so-called multipole fields. These multipole fields are produced by permanent-magnetic rings consisting of a slightly permeable material so that the deflection field will not be influenced.

Hitherto known multipole units consist of a support tube, a threaded ring which can be screwed onto the support tube, and a plurality of (permanent-) magnetic rings. The magnetic rings are arranged between the threaded ring and a flange on the opposite end of the support tube. For static convergence adjustment of a color picture tube, the magnetic rings can be rotated on the support tube. When the adjustment has been finished, the magnetic rings are fixed at the position in question by fully tightening the threaded ring. The static convergence adjustment for the color picture tube will be preserved permanently in this way.

In order to permit adjustment with the aid of the magnetic rings before said rings are fixed completely, said magnetic rings must be rotatably supported on the support tube without rotating on their own. They must always be held at their respective position in this adjustment phase. As soon as all the magnetic rings have been brought to their final position, the threaded ring is tightened firmly so as to fix the magnetic rings completely.

In the adjustment phase, the magnetic rings are held in a clamped condition. For this purpose, an additional spring ring is normally used between the magnetic rings. By means of a force acting in the axial direction, this spring ring clamps the magnetic rings between the threaded ring and the flange in the adjustment phase. The spring ring is provided with axially effective spring elements for this purpose.

Such a conventional structural design is disadvantageous insofar as an additional spring ring is required.

OBJECTS AND SUMMARY OF THE INVENTION

It is the object of the present invention to provide an improved multipole unit having a simplified structural design.

This object is achieved by providing a multipole unit for a color picture tube comprising a support tube, a retaining ring and at least one magnetic ring. The magnetic ring is attachable to the support tube and a spring element is provided between the retaining ring and a stop on the outer circumference of the support tube. The spring element acts in axial direction and is integrated in the stop or the retaining ring.

According to the present invention, a spring element is integrated in the retaining ring or in the flange of the support tube. A separate spring ring is therefore no longer necessary.

The structural design of the multipole unit according to the present invention has been simplified substantially in comparison with conventional multipole units, since the production as well as the mounting of an additional spring ring can be dispensed with.

Further advantageous embodiments of the present invention are disclosed below and in the claims.

BRIEF DESCRIPTION OF THE DRAWINGS

One embodiment of the invention is shown in the drawings, in which.

DETAILED DESCRIPTION OF THE PREFERRED EMBODIMENT

Figure 1:
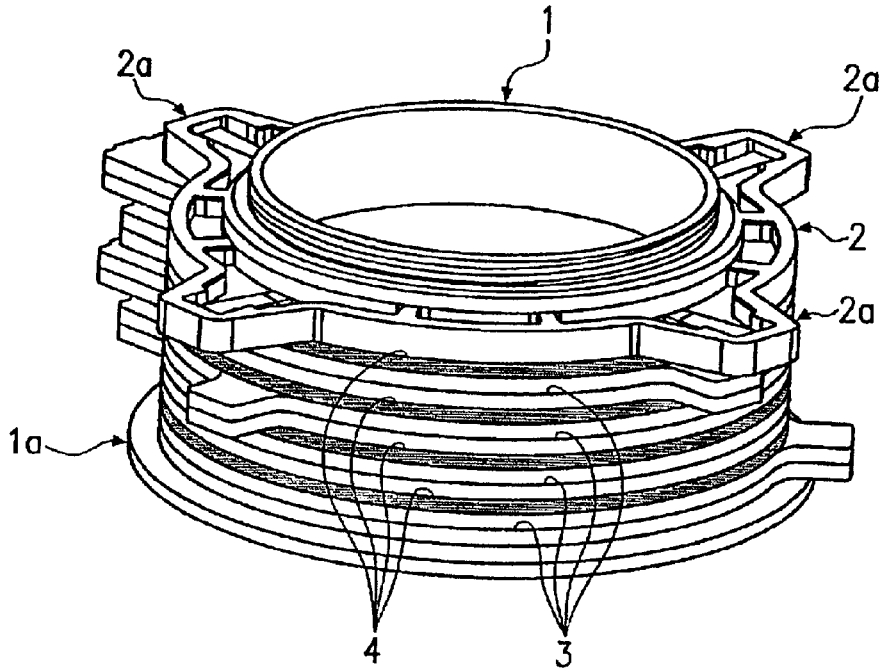
FIG. 1 shows a perspective view of the multipole unit.
Figure 2:
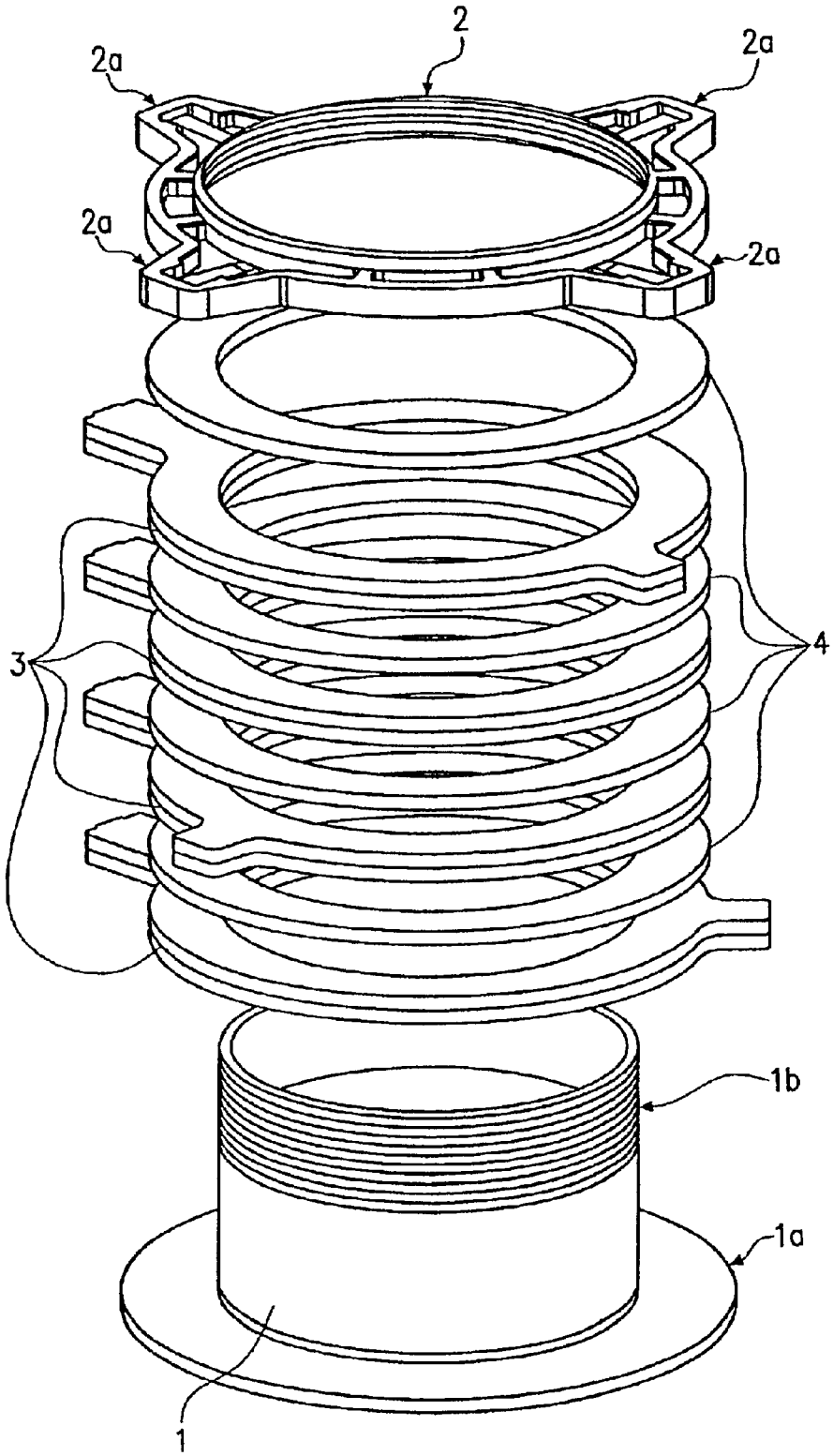
FIG. 2 shows an exploded view of the structural design of the multipole unit shown in FIG. 1.

FIGS. 1 and 2 show the multipole unit according to the present invention. In order to show the details of the structural design more clearly, the multipole unit shown in FIG. 1 in the assembled condition is shown in FIG. 2 in the form of an exploded view. The multipole unit according to the present invention comprises a support tube 1, at least one, preferably a plurality of magnetic rings 3 and a retaining ring 2. The support tube 1 is provided with a stop 1*a* at one end thereof, said stop being preferably implemented as a flange. A stop can also be realized with the aid of a few projections provided on the circumference of the support tube 1.

The multipole unit is assembled in the way indicated in FIG. 2. In so doing, the individual rings, which are arranged above the support tube 1 in FIG. 2, are attached to the support tube in the sequence shown in FIG. 2. The magnetic ring 3 or the magnetic rings 3 are first slipped onto the support tube and held by the flange 1*a*. Finally, the retaining ring 2 is attached so as to fix the magnetic ring or the magnetic rings in position on the support tube 1. The retaining ring 2 is preferably implemented as a threaded ring. The retaining ring may, however, also be implemented as a clip-on ring.

When it is implemented as a threaded ring, the retaining ring 2 is provided with a thread on the inner surface thereof. The support tube 1 is provided with a complementary thread 1*b* at the end located opposite the flange 1*a*, said thread 1*b* being arranged on the outer side of the support tube. The threaded ring 2 can thus be screwed onto the support tube 1. By tightening the threaded ring 2, the magnetic rings 3 can be fixed completely on the support tube.

In order to be able to achieve the desired rotatability of the magnetic rings prior to complete fixing, the threaded ring 2 must not be tightened completely so as to leave a certain amount of play for the rotatability of the magnetic rings. Simultaneously, the magnetic rings should, however, not be able to rotate independently so as to permit static convergence adjustment In order to permit this, the magnetic rings must be held in a clamped condition between the flange 1*a* and the threaded ring. For this purpose, a spring element 2*a* is provided in the threaded ring 2 or in the flange 1*a*. This spring element comprises a plurality of spring legs projecting beyond the threaded ring 2 or the flange 1*a*. The projecting ends are axially movable, whereby the spring legs will pretension the magnetic ring or the magnetic rings when the threaded ring is being tightened.

The magnetic rings can have arranged between them additional spacer rings 4. The spacer rings 4 preferably separate groups of two magnetic rings 3. A further spacer ring can be provided between the retaining ring 2 and a neighbouring magnetic ring 3. In total, eight magnetic rings are used in the embodiment shown.

Figure 3:
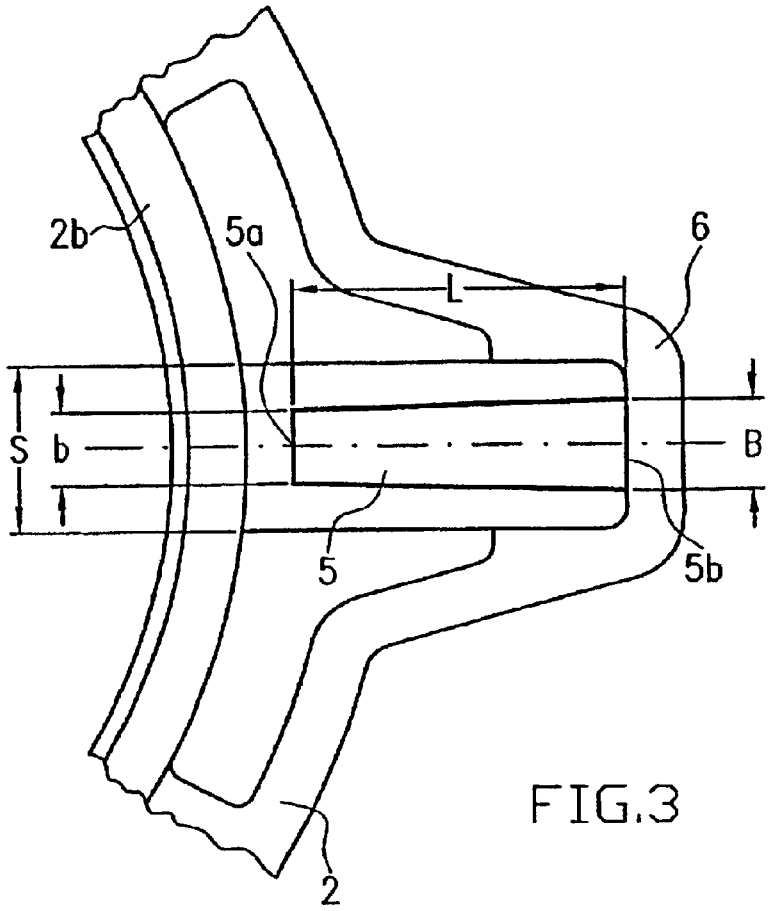
FIG. 3 shows an enlarged detail of a spring element according to the present invention.
Figure 4:
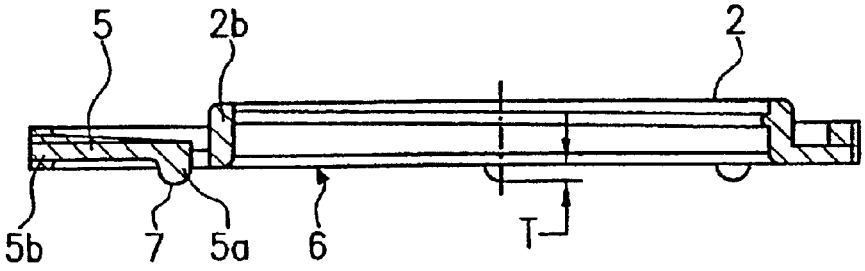
FIG. 4 shows a sectional side view of a threaded ring according to the present invention.

In FIGS. 3 and 4, the structural design of a spring leg of the spring element 2*a* is shown in detail. The spring leg 5 has one of its ends 5*b* secured to the retaining ring 2, whereas the other end 5*a* projects beyond the lower surface 6 of the retaining ring. The end 5*a* is preferably provided with an axial extension 7 or a portion of axially bent material which projects beyond the lower surface of the threaded ring 2. The end 5*a* of the spring leg 5 is movable in the axial direction. When the threaded ring 2 is being tightened, the free end 5*a* is displaced in the axial direction so that the spring leg 5 will pretension the rings arranged between the retaining ring 2 and the flange 1*a* and hold these rings in a clamped condition.

FIG. 3 shows the arrangement of a spring leg 5 in the outer circumference of the retaining ring 2. In the embodiment shown, the spring leg 5 is formed by an opening in the material of the retaining ring 2, said opening having the width S. The spring leg can be arranged radially (as shown) as well as tangentially. In the embodiment shown in FIG. 3, the circumference of the retaining ring 2 is enlarged at the points at which the respective spring legs are provided. The length and the width of the spring leg can be designed independently of the width of the threaded ring in this way. The enlargements 6 additionally permit a better hold when the threaded ring is tightened by hand.

The movability of the free end 5*a* depends on a plurality of parameters, e.g. on the depth T with which the axial extension 7 projects beyond the lower surface 6, as can be seen in FIG. 4, the geometrical dimensions, especially the length L and the widths b and B, respectively, and the properties of the material in question. The spring leg 5 shown in FIG. 3 slightly tapers from the width B at the location 5*b* where it is connected to the retaining ring 2 towards its free end 5*a* where it then has the width b. The threaded ring is preferably produced from plastic material.

In the case of a tangential arrangement of the spring legs, said spring legs are preferably arranged on the outer edge of the threaded ring.

In order to achieve a uniform clamping of the magnetic rings, several spring legs 5 are distributed uniformly over the circumference of the retaining ring 2 and of the flange 1*a*, respectively. At least two spring legs should be provided. In the preferred embodiment, four spring legs are provided.

In order to increase the torsional stiffness of a threaded ring according to the present invention, the threaded ring 2*b* is provided with a reinforced inner circumference.

Figure 5:
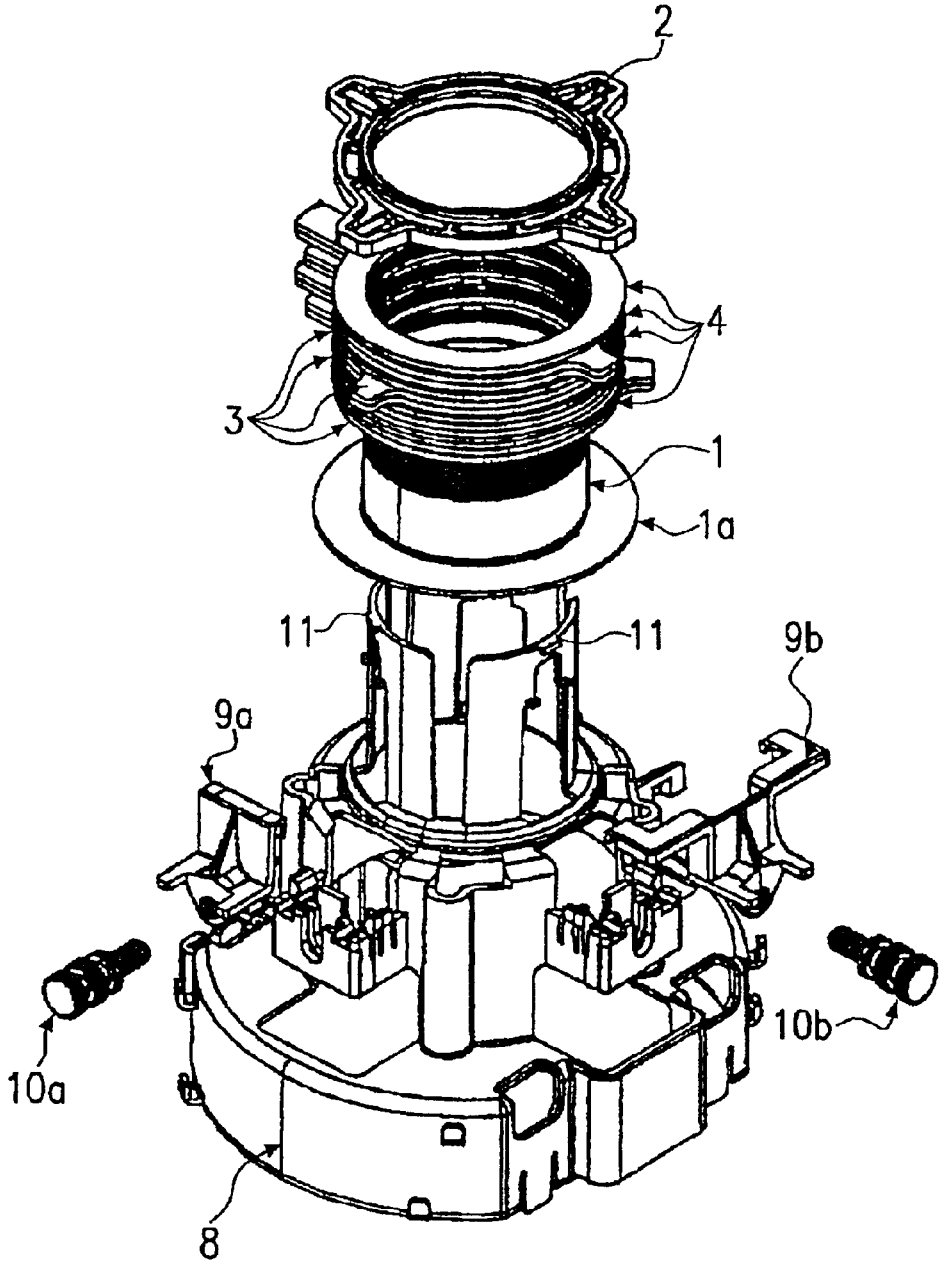
FIG. 5 shows an exploded view of the multipole unit according to the present invention together with a cap for mounting on a color picture tube.

FIG. 5 shows, by way of example, a device by means of which the multipole unit according to the present invention can be secured to a color picture tube. For this purpose, the multipole unit is attached to a cap 8 which is preferably produced from plastic material. This cap is adapted to be secured to the color picture tube. Hence, said cap has a substantially rotationally symmetric structural design and, at its axis of rotation, it is provided with a suitable opening for the neck of a color picture tube.

The multipole unit according to the present invention is attached to the cap 8 by means of the support tube 1. Small projections, which are provided on said support tube 1, prevent the support tube from being rotatably displaced on said cap 8. The cap 8 has small projections 11 at the rear end thereof, which prevent the multipole unit from slipping off said cap 8.

Also horizontal and vertical deflection windings can be secured to the picture tube with the aid of the cap 8. In this way, only one support system 8 will be required for securing all the deflection systems to a color picture tube. By means of further mechanical devices 9*a*, 9*b* and 10*a*, 10*b*, it is possible to mechanically adjust deflection systems on the cap 8.

Color picture tubes provided with the multipole units according to the present invention are preferably used in color television sets and color monitors for personal computers.

What is claimed is:

1. A multipole unit for a color picture tube comprising:

a support tube, a retaining ring and at least one magnetic ring, wherein said at least one magnetic ring is attached to the support tube, and a spring element is provided between the retaining ring and a stop on the outer circumference of the support tube, and wherein said spring element acts in axial direction and is integrated in the stop or the retaining ring, and wherein the spring element comprises at least one spring leg which is provided in outwardly protruding projection of the retaining ring and which is arranged radially.

2. A multipole unit for a color picture tube comprising:

a support tube, a retaining ring and at least one magnetic ring, wherein said at least one magnetic ring is attached to the support tube, and a spring element is provided between the retaining ring and a stop on the outer circumference of the support tube, wherein said spring element acts in axial direction and is integrated in the stop or the retaining ring, and wherein the spring element comprises at least one spring leg which is formed by an opening in the material of the retaining ring or the stop and which is provided with an axial extension or a portion of axially bent material at the free end thereof, and wherein each spring leg of the spring element is provided in outwardly protruding projections of the retaining ring and is arranged radially.

3. A multipole unit for a color picture tube comprising:

a support tube having a stop on an outer circumference thereof, a retaining ring, a spring element, and at least one magnetic ring, wherein said at least one magnetic ring is attached to the support tube, and a spring element is provided between the retaining ring and a stop on the outer circumference of the support tube, wherein the spring element acts in axial direction and is integrated in one of the stop and the retaining ring, and wherein the spring element comprises at least one spring leg which is provided in outwardly protruding projection of the retaining ring and which is arranged radially of the retaining ring.

4. A multipole unit for a color picture tube comprising:

a support tube having a stop on an outer circumference thereof, a retaining ring, a spring element, and at least one magnetic ring, wherein said at least one magnetic ring is attached to the support tube, and the spring element is provided between the retaining ring and the stop on the outer circumference of the support tube, wherein the spring element acts in axial direction and is integrated in one of the stop and the retaining ring, wherein the spring element comprises at least one spring leg which is formed by an opening in the material of one of the retaining ring and the stop and which is provided with one of an axial extension and a portion of axially bent material at a free end thereof, and wherein each spring leg of the spring element is provided in outwardly protruding projections of the retaining ring and is arranged radially of the retaining ring.

* * * * *